US012268915B2

(12) United States Patent
Schmidt

(10) Patent No.: US 12,268,915 B2
(45) Date of Patent: Apr. 8, 2025

(54) SAFETY CONTROL SYSTEM FOR MOTORIZED RESISTANCE EQUIPMENT UTILIZING ONE-WAY CLUTCHES

(71) Applicant: Schmidt Design, LLC, Darien, CT (US)

(72) Inventor: David Schmidt, Darien, CT (US)

(73) Assignee: Schmidt Design, LLC, Darien, CT (US)

( * ) Notice: Subject to any disclaimer, the term of this patent is extended or adjusted under 35 U.S.C. 154(b) by 0 days.

(21) Appl. No.: 18/530,753

(22) Filed: Dec. 6, 2023

(65) Prior Publication Data

US 2024/0100381 A1 Mar. 28, 2024

Related U.S. Application Data

(63) Continuation of application No. 17/516,254, filed on Nov. 1, 2021, now Pat. No. 11,883,708, which is a continuation of application No. 16/172,356, filed on Oct. 26, 2018, now Pat. No. 11,191,989.

(60) Provisional application No. 62/577,191, filed on Oct. 26, 2017.

(51) Int. Cl.

| | |
|---|---|
| ***A63B 21/005*** | (2006.01) |
| ***A63B 21/00*** | (2006.01) |
| ***A63B 24/00*** | (2006.01) |
| ***A63B 71/00*** | (2006.01) |
| *A63B 21/012* | (2006.01) |

(52) U.S. Cl.

CPC ..... *A63B 21/0057* (2013.01); *A63B 21/0058* (2013.01); *A63B 21/153* (2013.01); *A63B 21/157* (2013.01); *A63B 24/0087* (2013.01); *A63B 71/0054* (2013.01); *A63B 21/00069* (2013.01); *A63B 21/0125* (2013.01); *A63B 2024/0093* (2013.01); *A63B 2071/0072* (2013.01); *A63B 2220/58* (2013.01)

(58) Field of Classification Search

CPC ..... A63B 21/00069; A63B 21/0057; A63B 21/0058; A63B 21/0125; A63B 21/153; A63B 21/157; A63B 24/0087; A63B 69/0035; A63B 71/0054; A63B 2024/0093; A63B 2069/0037; A63B 2071/0072; A63B 2220/58

See application file for complete search history.

(56) References Cited

U.S. PATENT DOCUMENTS

| | | | | | |
|---|---|---|---|---|---|
| 3,902,480 | A * | 9/1975 | Wilson | A63B 21/0083 | 482/7 |
| 4,082,267 | A * | 4/1978 | Flavell | A63B 21/153 | 74/141 |
| 4,184,678 | A * | 1/1980 | Flavell | A63B 21/153 | 482/901 |
| 4,912,638 | A * | 3/1990 | Pratt, Jr. | A63B 21/4005 | 600/595 |
| 4,979,733 | A * | 12/1990 | Prud'Hon | A63B 21/153 | 482/901 |
| 5,435,798 | A * | 7/1995 | Habing | A63B 21/0615 | 482/903 |
| 5,476,428 | A * | 12/1995 | Potash | A63B 21/063 | 482/99 |

(Continued)

*Primary Examiner* — Joshua Lee

(57) ABSTRACT

A safety control system for use with an exercise apparatus utilizing a one-way clutch includes a rope wrapped around a spindle driven by a motor. A controller is capable of applying a brake when power loss is detected by an internal circuit to ensure the safety of the apparatus and user.

4 Claims, 4 Drawing Sheets

(56) References Cited

U.S. PATENT DOCUMENTS 5,618,245 A * 4/1997 Trulaske ..... A63B 22/025 482/7
5,697,869 A * 12/1997 Ehrenfried ..... A63B 21/157 482/7
5,813,945 A * 9/1998 Bernacki ..... A63B 21/153 434/254
6,050,920 A * 4/2000 Ehrenfried ..... A63B 21/153 482/7
6,368,251 B1 * 4/2002 Casler ..... A63B 23/03525 482/901
8,167,620 B1 * 5/2012 Baker ..... G09B 19/00 482/115
10,456,614 B1 * 10/2019 Dube ..... A63B 24/0062
10,617,903 B2 * 4/2020 Orady ..... A63B 23/12
10,987,565 B2 * 4/2021 Orady ..... A63B 21/4043
2004/0206845 A1 * 10/2004 Aichinger ..... A63B 21/4043 242/390.8
2009/0009110 A1 * 1/2009 Wang ..... A63B 21/0058 318/261
2012/0279801 A1 * 11/2012 Watson ..... B66D 1/505 182/19
2012/0325106 A1 * 12/2012 Von Lerchenfeld ..... A63B 69/187 104/173.2
2013/0267384 A1 * 10/2013 Eldridge ..... A63B 24/0062 482/5
2014/0038777 A1 * 2/2014 Bird ..... A63B 23/03525 482/5
2016/0354638 A1 * 12/2016 Carr ..... A63B 21/4043
2018/0021616 A1 * 1/2018 Orady ..... A63B 24/0087 482/5
2018/0071605 A1 * 3/2018 Freedman ..... A63B 69/0026
2018/0214729 A1 * 8/2018 Rubin ..... A63B 24/0087
2019/0070448 A1 * 3/2019 Jeremic ..... A63B 21/0059
2019/0099652 A1 * 4/2019 Orady ..... A63B 71/0054
2020/0070032 A1 * 3/2020 Orady ..... H02P 3/22

* cited by examiner

SAFETY CONTROL SYSTEM FOR MOTORIZED RESISTANCE EQUIPMENT UTILIZING ONE-WAY CLUTCHES

CROSS-REFERENCE TO RELATED APPLICATION

This application claims the benefit of U.S. Provisional Patent Application No. 62/577,191 filed Oct. 26, 2017, U.S. Non-Provisional patent application Ser. No. 16/172,356 filed Oct. 26, 2018, and U.S. Non-Provisional patent application Ser. No. 17/516,254 filed Nov. 1, 2021, all of which are hereby incorporated by reference in its entirety herein.

BACKGROUND OF THE INVENTION

I. Field of the Invention

The present disclosure relates generally to a control system for use with motorized resistance equipment that utilize one-way clutches, and more specifically to a system that instantly engages or disengages the resistance mechanism of resistance equipment that provide resistance in a single direction.

II. Description of the Prior Art

Typical motorized exercise equipment works the heart and lungs together with various muscle groups to allegedly improve a user's endurance and strength. The devices typically require the user to run, jog, walk, bike, climb and the like for a prolonged period of time to build up the lungs and heart, as well as to promote muscle health. Examples of such equipment includes motorized weights, treadmills, elliptical machines, exercise bikes, steppers and the like.

Regardless of the type of motorized exercise device, it is nevertheless the motor component of these devices that ultimately provides the necessary resistance to the user movement and thus exercise. This resistance can take many forms. Indeed, resistance machines can employ isokinetic (constant speed) resistance, isotonic (constant force) resistance, or combinations thereof and/or other variations of resistance. Further, such resistance can differ from one direction to another (e.g. eccentric contraction vs. concentric contraction).

One such exercise device is disclosed in the current applicant co-pending patent application Ser. No. 16/169,171 entitled Body Tether Exercise Apparatus and incorporated herein by reference. This device essentially utilizes a rope wound about a spool mounted on a motor driven driveshaft for rotation in a user engageable forward direction. The spool includes a one-way clutch for engaging the driveshaft in the forward direction. A recoil mechanism is coupled to the spool for rotation of the spool in the backward direction.

While adding the motor component to such devices provides a multitude of resistance type parameters to user exercise, it unfortunately also adds safety concerns to the equipment, and more importantly, to the user of such equipment. For example, and with respect to the aforementioned Body Tether Exercise Apparatus, if the rope is not properly guided it may wrap around the driveshaft causing it to jam and lock onto the shaft. The spinning shaft would then cause the rope to wind on the shaft and pull the user engageable end, and possibly the user, causing harm to both. Similar damage could be caused if the one-way clutch mechanism fails and locks onto the spinning drive shaft. In this case, the rope would be paid out fully and then wound back in with the full force of the motor.

The present disclosure overcomes the safety problems associated with numerous motorized exercise machines. Accordingly, it is a general object of this disclosure to provide a safety control system for motorized resistance equipment utilizing a one-way clutch.

It is another general object of the present disclosure to provide a safety control system that instantly engages or disengages the resistance provided by a motorized single direction resistance exercise device.

It is a more specific object of the present disclosure to provide a safety control system that monitors and limits current flow to the motor of an exercise device.

It is another more specific object of the present disclosure to provide a safety control system that senses force and limits current flow to the motor of an exercise device.

Yet another object of the present disclosure is to provide a safety control system that includes an automatic rope braking mechanism.

Still another object of the present disclosure is to provide a safety control system that disconnects power to the motorized resistance equipment.

These and other objects, features and advantages of this disclosure will be clearly understood through a consideration of the following detailed description.

SUMMARY OF THE INVENTION

According to an embodiment of the present disclosure, there is provided a safety control for exercise equipment having a flexible element wound about a spindle driven by a motor. The system includes a circuit for detecting power loss, a brake, and a controller. The controller applies the brake when power loss is detected.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

One or more embodiments of the subject disclosure will now be described with the aid of numerous drawings. Unless otherwise indicated, use of specific terms will be understood to include multiple versions and forms thereof.

Figure 1:
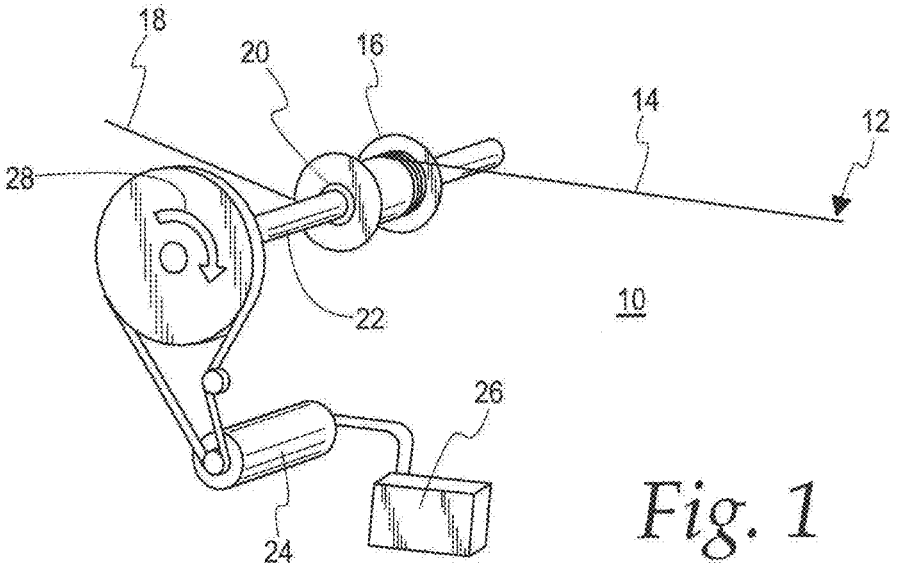
FIG. 1 is a perspective view of the component parts of a safety control system for an exercise machine according to the principles of an embodiment of the present disclosure.

The component parts of a safety control system 10 for motorized resistance equipment utilizing a one-way clutch are illustrated in the perspective view of FIG. 1. Here the user engageable end 12 of a flexible element 14, such as a cable, line or rope, is wrapped around a spool or spindle 16. The spindle 16 may utilize a recoil device 18, such as a bungee cord wrapped in the opposite direction, or other mechanism or recoil motor. The rotational bearing of the spindle 16 includes a one-way clutch 20 and the spindle assembly is mounted on a shaft 22 driven by a motor 24. The motor 24 uses a controller 26 capable of providing power (power state) to the motor, as well as braking (braking state) the motor. The power state is used when there is a load on the motor, and the braking state is used when there is an overrun load on the motor.

One method of operation of the system of FIG. 1 includes commanding the controller 26 to maintain a constant motor direction 28 and speed. When the user engageable end 12 is left at rest, the spindle 16 idles on the drive shaft 22, and the speed controller 26 commands the motor 24 to rotate at a constant speed. This is the power state. When the user engageable end 12 is pulled with sufficient speed and force to exceed the commanded motor speed, the one-way clutch 20 locks onto the driveshaft 22 and the force of the user's actions attempts to accelerate the motor rotation. The motor controller 26 senses this acceleration and commands a braking state. When the user releases pressure on the rope 14, the spindle 16 slows and the one-way clutch 20 disengages from the driveshaft 22 at which point the recoil mechanism 18 can retract the user engageable end 12.

During proper operation, this system allows the user to pull with any force, yet as soon as pulling is stopped, only the recoil force is experienced, pulling the user engageable end away from the user. For some applications it may be desirous to specify a motor and controller combination with enough braking torque to withstand a significant pull from an athlete (e.g. 800 lbs.). In any event, care must be taken, however, in designing the system to provide for safe operation.

In one embodiment, the speed controller, within the motor controller 26, can independently limit current flow to the motor 24 for the power state and the braking state. Current flow through the motor is very low (e.g. less than one amp) during the power state, as the only resistance to rotation is from the power transfer components (e.g. drive belt) and the bearings in the system. Depending on the force applied to the user engageable end 12 of the rope 14, the (absolute value of the) current flow through the motor 24 during braking state can be very high (e.g. −5 amps).

A low current limit (e.g. 1 amp) is applied to the power state, while a high current limit (e.g. 8 amps) is applied to the braking state. Switching from one state to another can be instantaneous or ramped in order to minimize awareness of the transition by the user. In the event of a clutch 20 failure or other wrapping scenario such that the flexible element 14 becomes pulled rather than released by the motor 24, the total force of pull will be limited to a low value (e.g. 10 lbs.) due to the low current limit set during the power state.

Figure 2:
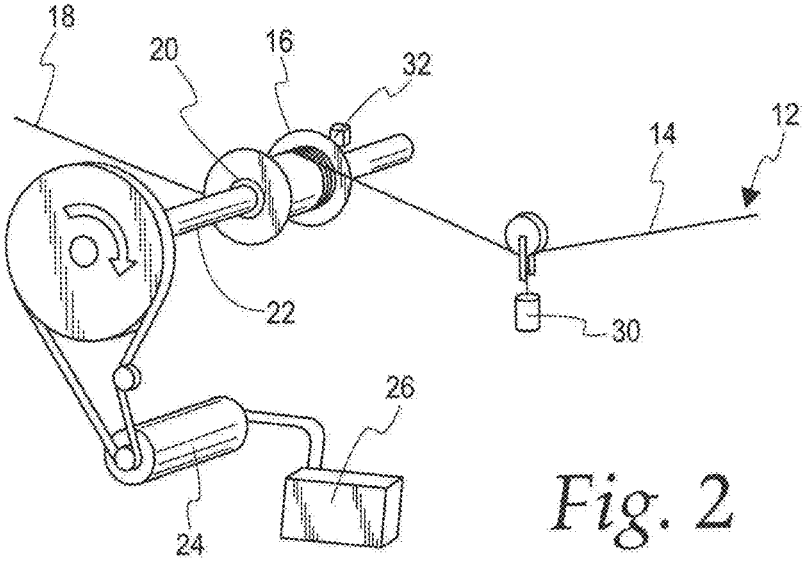
FIG. 2 is a perspective view of the component parts of a safety control system for an exercise machine according to the principles of an alternate embodiment of the present disclosure.

An alternate embodiment of the safety control system for motorized resistance equipment utilizing a one-way clutch is shown in FIG. 2. Here, a force sensor (e.g. strain gauge, load cell, spring switch, current sensor, etc.) is used to measure the force applied to the flexible element 14; and a flexible element direction sensor (e.g. rotary encoder, linear encoder, mechanical switch, etc.) is used to determine whether the flexible element 14 is moving in at least a first direction.

During normal use, the flexible element 14 is pulled in the first direction with deliberate force, typically greater than 5 lbs. When the flexible element 14 is released back in the second direction, the recoil system 18 takes up the slack and the measured force is typically less than 3 lbs. A logic control circuit within the controller 26 monitors both the force and direction information. If the flexible element 14 is being pulled in the first direction, the system operates normally. If the flexible element moves in the second direction, and the force detected is above a threshold (e.g. 5 lbs.), it is assumed that there is a clutch failure or other wrapping scenario, and a failure command is executed. The failure command either temporarily or permanently reduces the ability of the motor 24 to supply torque to the spindle 16. This can include reducing the current limit to the motor 24, slowing the motor 24, mechanically disengaging the motor 24 from the spindle 16, braking the motor 24, removing power completely from the motor 24, and mechanically stopping movement of the flexible element 14.

Figure 3:
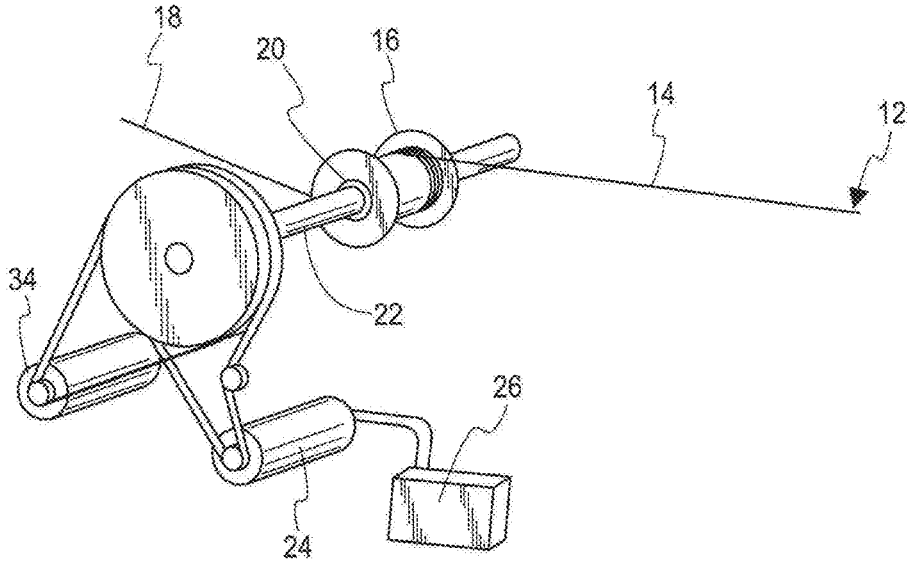
FIG. 3 is a perspective view of the component parts of a safety control system for an exercise machine according to the principles of an alternate embodiment of the present disclosure.

Another alternate embodiment of the safety control system for motorized resistance equipment utilizing a one-way clutch is shown in FIG. 3. Here, a small motor is used in combination with a brake 34. The motor 24 is designed to provide enough torque to overcome the friction caused by the mechanical components, such as the bearings and the one-way clutch 20. When the user engageable end 12 of the flexible element 14 is pulled and the spindle 16 begins to accelerate, the brake 34 is automatically applied to control the speed of the spindle 16. Because the motor 24 only applies to a low torque, a wrap or clutch failure will not result in injury to the user.

Figure 4A:
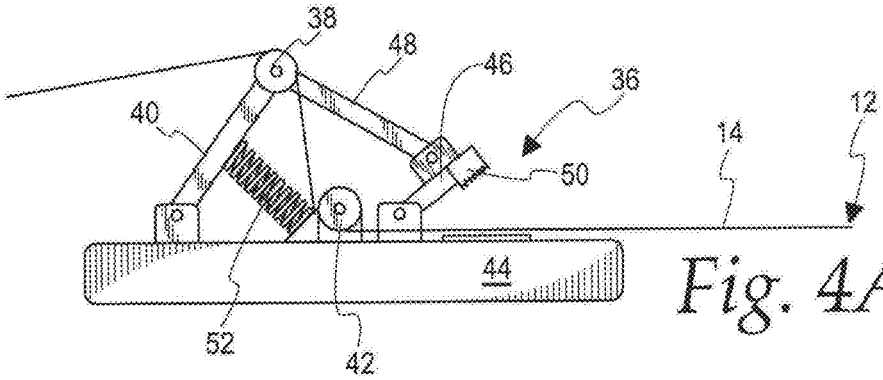
FIG. 4A is a side view of the component parts of a safety control system for an exercise machine according to the principles of an alternate embodiment of the present disclosure in the open state.
Figure 4B:
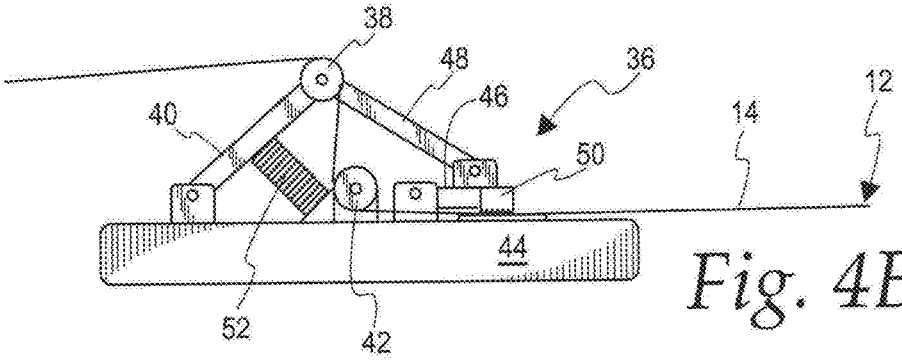
FIG. 4B is a side view of the component parts of a safety control system of FIG. 4A in the closed state.

A further embodiment of the safety control system for motorized resistance equipment utilizing a one-way clutch is shown in FIG. 4. Here, an automatic brake mechanism is employed. This can take the form of a spring-loaded cam mechanism 36 or the like built around the flexible element 14 prior to it reaching the user engageable end 12. A first pulley 38 is mounted on a spring-loaded pivot arm 40. A second pulley 42 is fixed to a frame 44 beneath the first pulley 38. A second pivot arm 46 is mounted to the frame 44 and attached to the spring-loaded pivot arm 40 with a linkage 48. A one-way locking mechanism 50 is mounted to the second pivot arm 46. The flexible element 14 is fed over the first pulley 38 and under the second pulley 42 such that it exits beneath the one-way locking mechanism 50. The spring 52 is chosen so that when there is a force greater than the recoil force on the flexible element 14 (e.g. greater than 10 lbs.), the first lever arm 40 compresses the spring 52 and causes the second lever arm 46 to move down via the linkage 48 causing the one-way locking mechanism 50 to come in contact with the flexible element 14.

When the user pulls with a force greater than 10 lbs., for example, the one-way locking mechanism 50 presses against the flexible element 14. Since the flexible element is moving in the non-locking direction of the one-way locking mechanism 50, it is able to pass unhindered. If there is a malfunction and the flexible element 14 is pulled into the machine with greater than 10 lbs. of force, the one-way locking mechanism 50 will come in contact with the flexible element 14 and prevent it from being retracted.

Figure 5A:
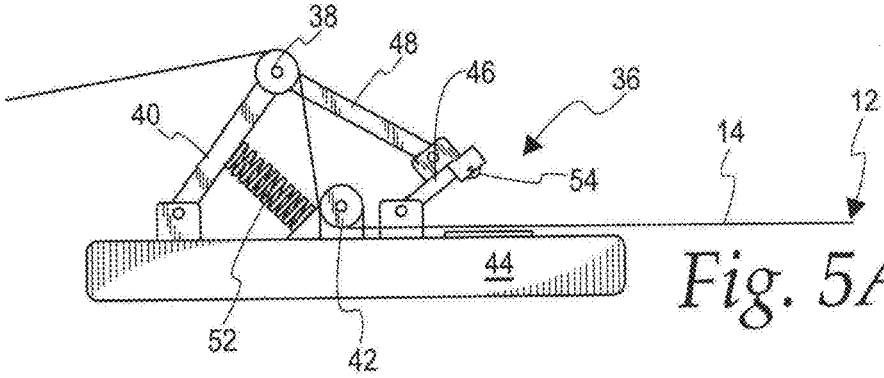
FIG. 5A is a side view of the component parts of a safety control system for an exercise machine according to the principles of an alternate embodiment of the present disclosure in the closed state.
Figure 5B:
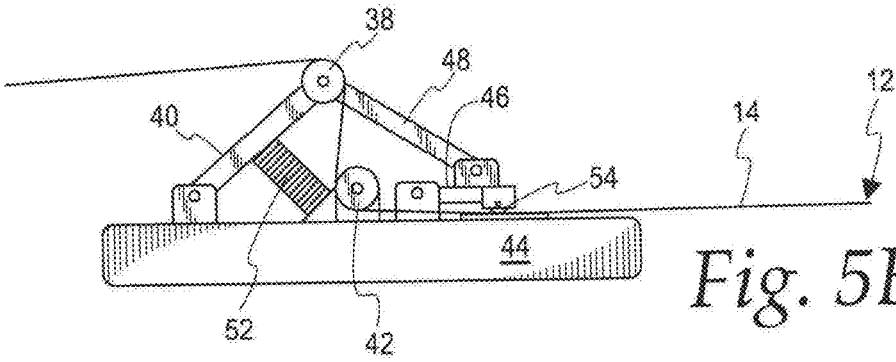
FIG. 5B is a side view of the component parts of a safety control system in FIG. 5A in the closed state.

Yet another further embodiment of the safety control system for motorized resistance equipment utilizing a one-way clutch is shown in FIG. 5. Here, a cam is used to disconnect the power from the drive motor during failure mode. A pulley 38 is mounted on a spring-loaded pivot arm 40. A second pulley 42 is fixed to a frame beneath the first pulley 38. A second pivot arm 46 is mounted to the frame and attached to the spring-loaded pivot arm 40 with a linkage 48. An electrical switch 54 is mounted to the second pivot arm 46. The flexible element 14 is fed over the first pulley 38 and under the second pulley 42 such that it exits beneath the electrical switch 54. The spring 52 is chosen so that when there is a force greater than the recoil force on the flexible element 14 (e.g. greater than 10 lbs.), the first lever arm 40 compresses the spring 52 and causes the second lever arm 52 to move down via the linkage 48 causing the electrical switch 54 to come in contact with the flexible element 14. The electrical switch 54 directs power to the drive motor and/or brake and is preset in the "on" direction. If the flexible element 14 is pulled in a first direction with greater than 10 lbs., for example, the linkage 48 brings the switch 54 in contact with the flexible element 14 and the switch remains "on". If the flexible element 14 is pulled in a second direction with greater than 10 lbs., the switch is moved to the "off" position and power is removed from the drive motor 24 or a brake is activated.

Figure 6:
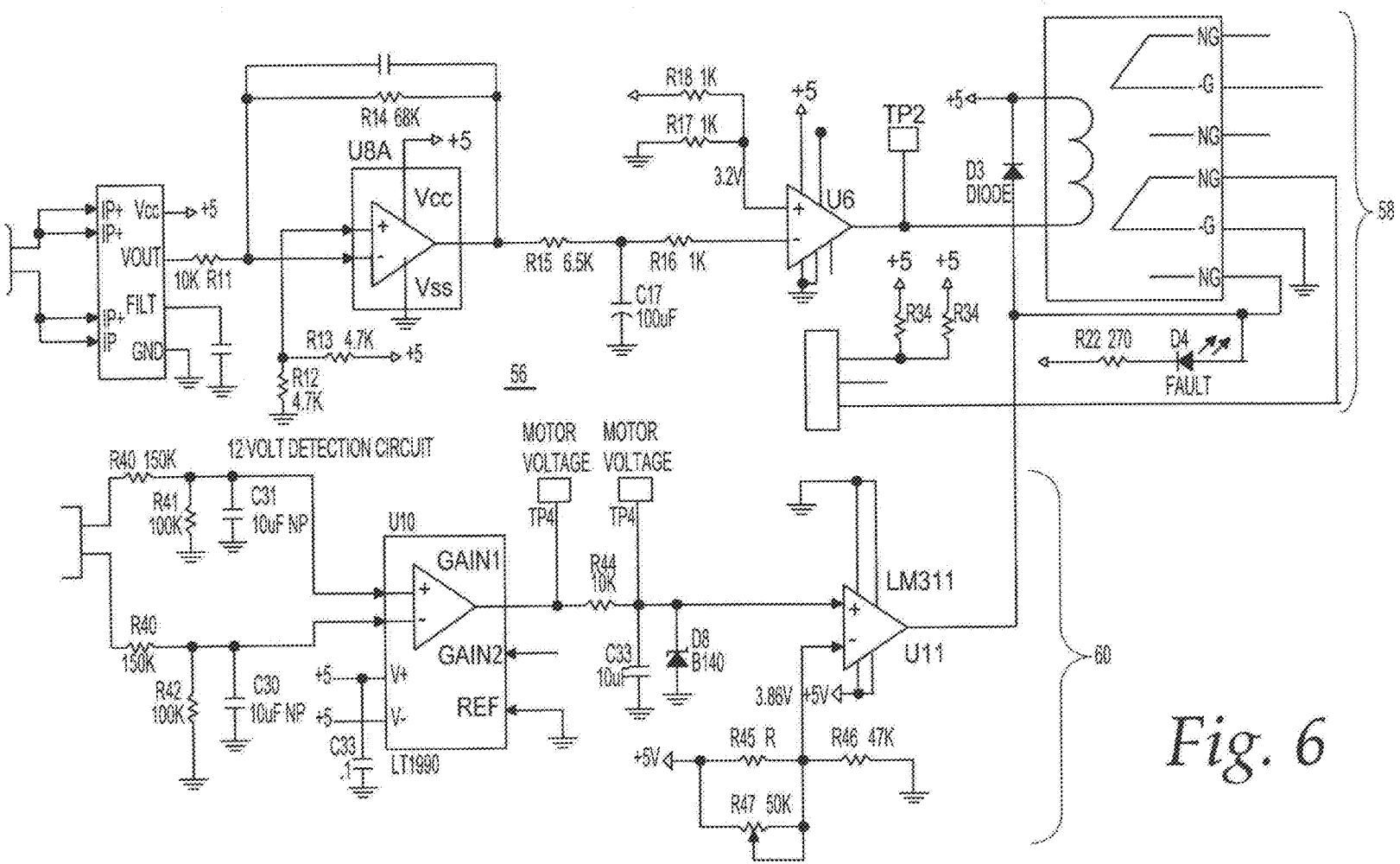
FIG. 6 is a circuit diagram of a safety circuit for use in the safety control system for motorized resistance equipment utilizing a one-way clutch according to the principles of the present disclosure.

Turning now to the safety circuits 56 of FIG. 6. First, circuit 58 monitors the motor current with U10. The current is monitored continuously by U5 with U5 output smoothed by R15 and C17 so quick transits will not activate the safety comparator circuit. The output voltage of this circuit is then fed into the comparator circuit (U6) with the trip point set with R45 and R46. If there is a malfunction causing the flexible element to be pulled into the machine and the motor current reaches the setpoint of U6, the relay K1 is activated and thus disables the main motor controller by opening the E1 (motor enable) and turning off the motor. It will be understood that other depowering and braking methods may also be deployed.

The direction of rotation of a motor can be determined by monitoring the voltage flow through the motor. Circuit 60 monitors drive voltage looking for the voltage to go negative indicating a failure. This circuit monitors the main motor's drive voltage with U10. The signal voltage output of U10 is smoothed by R44 and C33 so fast transits will not activate the comparator circuit. This voltage is then fed into the comparator circuit U11. The trip point for this circuit is set with R45 and R46. If there is a motor controller failure, or other malfunction which would cause the motor to reverse direction, the motor voltage will reach the set trip point and U11 will activate K1 disabling the main motor controller by opening the E1 (motor enable) and turning off the motor. It will be understood that other depowering and braking methods may also be deployed.

When using the described system, there may be times when a user is pulling with significant force, or simply "trusting" the machine by leaning back and knowing that as long as the flexible element is paid out at a fixed speed, the user will be in a "controlled fall" which he/she can manage as part of the desired body movement. However, if the flexible element were suddenly released, as might happen for example during a power failure, the user would run the risk of falling.

In one embodiment, the regenerative nature of the motor is used as a brake in the event of power loss or other malfunction. When power loss or a malfunction is detected, a switching relay is used to disconnect the motor from the drive, and put a direct short, or low value resistance across the motor leads. This will cause the motor to become a generator and maintain a torque thereby controlling the payout of the flexible element.

It will be understood that an external brake, as known in the art (e.g. StepperOnline DC Electromagnetic 24V Brake, etc.) can be used instead of the regenerative nature of the above-described motor. Indeed, it will be appreciated that numerous types of systems, methods and devices may be employed for such change in motor speed.

Although the above described brakes are an effective means of slowing the payout of the flexible element, there may be times when a user is moving at a very fast speed with low force production where it can be dangerous to brake aggressively. For example, if the user is running at full speed while wearing a vest or belt tied to the flexible element, a sudden braking of the system might injure the user due to the sudden stop.

In one embodiment, a circuit monitors the voltage at the motor armature. Because armature voltage varies with motor speed, the equipment designer can choose a threshold voltage (speed) above which it is not desirable to activate a brake in the event of a power failure. A power detecting device, such as a relay, works in conjunction with a voltage comparator. The power detecting device utilizes a capacitor, battery, or other temporary power source which will temporarily keep power to the circuit in the event of a power failure If a power failure is detected, the voltage comparator is monitored to either do nothing in the event the voltage (motor speed) is above a threshold, or activate the brake if the voltage (motor speed) is below a threshold. This method can also use a graduated brake varying from zero to full braking. In this case, a variable resistor, or set of resistors can be selected based on the speed of the system.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. A safety control system for exercise equipment having a flexible element wound about a spindle driven by a motor, the system comprising:

a circuit for detecting a power loss and for monitoring a motor speed;

a brake; and a controller capable of applying said brake when a power loss is detected whereby the brake applies a graduated torque based upon said monitored speed to control a payout of said flexible element wherein said graduated torque is zero when said speed is above a threshold value and said graduated torque graduates to full as said speed declines to a zero value.

2. The system as defined in claim 1 wherein said brake is said motor.

3. The system as defined in claim 1 wherein said brake is an external brake.

4. The system as defined in claim 1 wherein said controller has a back-up power supply.

* * * * *